US010954968B2

(12) United States Patent
Kumeuchi et al.

(10) Patent No.: US 10,954,968 B2
(45) Date of Patent: Mar. 23, 2021

(54) OPERATION CONTROL DEVICE FOR WORKING VEHICLE

(71) Applicant: Takeuchi Mfg. Co., Ltd., Nagano (JP)

(72) Inventors: Kengo Kumeuchi, Chikuma (JP); Koichi Shimizu, Ueda (JP); Shumpei Okutani, Ueda (JP); Yuta Kobayashi, Tomi (JP)

(73) Assignee: Takeuchi Mfg. Co., Ltd., Nagano (JP)

( * ) Notice: Subject to any disclaimer, the term of this patent is extended or adjusted under 35 U.S.C. 154(b) by 0 days.

(21) Appl. No.: 16/672,441

(22) Filed: Nov. 2, 2019

(65) Prior Publication Data

US 2020/0318656 A1 Oct. 8, 2020

(30) Foreign Application Priority Data

Apr. 5, 2019 (JP) ..... JP2019-072591

(51) Int. Cl.
*F15B 9/04* (2006.01)
*E02F 9/22* (2006.01)

(52) U.S. Cl.
CPC ..... *F15B 9/04* (2013.01); *E02F 9/2267* (2013.01); *E02F 9/2271* (2013.01)

(58) Field of Classification Search
CPC . F15B 2211/20515; F15B 9/04; E02F 9/2271; E02F 9/2292; E02F 9/2267
See application file for complete search history.

(56) References Cited

U.S. PATENT DOCUMENTS 9,032,724 B2 * 5/2015 Pfaff ..... E02F 9/2242 60/428
2017/0292243 A1 10/2017 Okada et al.
2018/0038079 A1 2/2018 Amano et al.
2018/0058042 A1 3/2018 Moriki et al.
2018/0163374 A1 6/2018 Imura et al.

FOREIGN PATENT DOCUMENTS

EP 2444555 A1 * 4/2012 ..... F15B 11/17
EP 2444555 A1 4/2012
JP 5096417 B2 12/2012

OTHER PUBLICATIONS

The extended European search report issued by the European Patent Office dated Sep. 10, 2020, which corresponds to European Patent Application No. 19207218.9-1016 and is related to U.S. Appl. No. 16/672,441.

* cited by examiner

*Primary Examiner* — Abiy Teka
(74) *Attorney, Agent, or Firm* — Studebaker & Brackett PC

(57) ABSTRACT

An operation control device for a working vehicle which includes a hydraulic working device, comprises a hydraulic actuator to drive the hydraulic working device, an operating oil supply source for driving the hydraulic actuator, a sent-out oil amount control device that controls the amount of oil sent out from the operating oil supply source, an operating device to be operated to make the hydraulic actuator work, and an operating oil supply control device that performs control to supply operating oil to the hydraulic actuator according to operation of the operating device. The sent-out oil amount control device controls the amount of oil sent out from the operating oil supply source according to the operation amount of the operating device.

5 Claims, 8 Drawing Sheets

OPERATION CONTROL DEVICE FOR WORKING VEHICLE

TECHNICAL FIELD

The present invention relates to an operation control device for a working vehicle.

TECHNICAL BACKGROUND

Hydraulic shovels (excavators) are known as working vehicles. The hydraulic shovel is configured to comprise a traveling unit having right and left crawler mechanisms, a turning body pivotally provided on the top of the traveling unit, and a shovel device provided on the front of the turning body. As such a hydraulic shovel, there is known a hydraulic shovel which comprises a power supply unit having a battery and an inverter, an electric motor receiving electric power from the power supply unit to drive, a hydraulic pump driven by the electric motor, and a plurality of hydraulic actuators (hydraulic motors, hydraulic cylinders, etc.) receiving operating oil discharged from the hydraulic pump to operate and which is configured to make the crawler mechanisms, the shovel device, and the like operate by these hydraulic actuators so as to perform travelling, excavation, and the like.

As such hydraulic actuators, there are a travelling motor to make the crawler mechanisms operate, a turning motor to make the turning body pivot, a boom cylinder to make the shovel device operate, an arm cylinder, a bucket cylinder, a swing cylinder, a blade cylinder to make a blade vertically move, and so on. Among conventional hydraulic shovels, there is known a shovel which comprises an operation control device configured to drive a plurality of hydraulic pumps (including a pilot pump) by one electric motor and, using operating oil discharged from those hydraulic pumps, to make the above-mentioned plurality of hydraulic actuators operate and to generate pilot pressures. This operation control device needs to drive all the hydraulic pumps by one electric motor such that pump discharge pressure corresponds to the highest pressure under load among all the hydraulic actuators, and thus excess energy consumption by that electric motor is large in amount.

Accordingly, there is also known an operation control device which comprises two electric motors and is configured to make the travelling motor and the hydraulic cylinders (boom cylinder and the like) of the shovel device operate using operating oil from a hydraulic pump driven by a first electric motor and, using operating oil from a hydraulic pump driven by a second electric motor, to make the turning motor and the blade cylinder operate and to generate pilot pressures (see, e.g., Patent Document 1). This operation control device can suppress the rotational speed (number of rotations per unit time) of the second electric motor (electric motor for turning and so on) to be low when performing only travelling and the operation of the shovel device and suppress the rotational speed of the first electric motor (electric motor for travelling and so on) to be low when performing only turning and the operation of the blade, and thus energy consumption by the two electric motors can be suppressed.

Patent Document 1: Japanese Patent Publication No. 5096417

In a conventional operation control device, because by feedback control in which the flow rate of discharge from the hydraulic pump is determined based on the difference between operating oil pressure on the hydraulic pump side and operating oil pressure on the hydraulic actuator side, the flow rate of discharge from the hydraulic pump is controlled, control responsivity is relatively slow. Thus, there is the problem that during the control of the discharge flow rate, in the situation where the differential pressure abruptly changes, a control delay occurs, so that hunting is likely to occur and that in the situation where the differential pressure changes only slightly, the responsivity is likely to be poor.

SUMMARY OF THE INVENTION

In view of this problem, the present invention was made, and an object thereof is to provide an operation control device for a working vehicle which can control the discharge flow rate preventing hunting and decrease in responsivity during control of the flow rate of discharge from the hydraulic pump.

In order to achieve the above object, according to the present invention, an operation control device for a working vehicle (e.g., a hydraulic shovel 1 in the embodiment) which includes a hydraulic working device (e.g., a crawler mechanism 15, turning body 20, or shovel device 30 in the embodiment), comprises a hydraulic actuator (e.g., a traveling motor 16L, 16R, swing cylinder 34, boom cylinder 36, arm cylinder 37, bucket cylinder 38, or blade cylinder 19 in the embodiment) to drive the hydraulic working device; an operating oil supply source (e.g., a first hydraulic pump P1 and first electric motor M1 in the embodiment) that sends out operating oil necessary for driving the hydraulic actuator; a sent-out oil amount control device (e.g., the controller 150 in the embodiment) that controls the amount of oil sent out from the operating oil supply source; an operating device to be operated to make the hydraulic actuator work so as to drive the hydraulic working device; and an operating oil supply control device (e.g., control valves 111 to 118 in the embodiment) that performs control to supply operating oil sent out from the operating oil supply source to the hydraulic actuator according to operation of the operating device. The sent-out oil amount control device is configured to control the amount of oil sent out from the operating oil supply source according to the operation amount of the operating device.

In the operation control device having the above configuration, the operation control device further comprises a plurality of hydraulic working devices, a plurality of hydraulic actuators to drive the plurality of hydraulic working devices and a plurality of operating oil supply control devices corresponding to the plurality of hydraulic actuators and is configured such that the operating device performs a plurality of operations corresponding to a plurality of operations of the operating device. When a plurality of operations are performed by the operating device, the sent-out amount control device controls the amount of oil sent out from the operating oil supply source according to the sum operation amount of the plurality of operations.

In the operation control device having the above configuration, the operating device is configured to output an operation signal according to an operation amount. The sent-out oil amount control device is preferably configured to, when a plurality of operations are performed on the operating device, control the amount of oil sent out from the operating oil supply source based on the sum of a plurality of operation signals outputted due to the plurality of operations.

In the operation control device having the above configuration, the sent-out oil amount control device is preferably configured to, when a plurality of operations are performed on the operating device, weight the plurality of operation signals according to operating characteristics of the hydraulic actuators corresponding to the operations respectively and to control the amount of oil sent out from the operating oil supply source based on the sum of the plurality of weighted operation signals.

The operating characteristic of the hydraulic actuator is preferably a necessary operating oil amount of the hydraulic actuator corresponding to an operation of the operating device.

The operating oil supply source is a hydraulic pump and an electric motor to drive the hydraulic pump, and the sent-out oil amount control device is preferably configured to control the amount of oil sent out from the hydraulic pump by controlling the rotational frequency of the electric motor. In that case, the hydraulic pump is preferably a fixed-capacity-type hydraulic pump.

The operating oil supply source is a variable-capacity-type hydraulic pump and an engine to drive the hydraulic pump, and the sent-out oil amount control device may be configured to control the amount of oil sent out from the hydraulic pump by controlling the capacity of the variable-capacity-type hydraulic pump.

The operation control device for the working vehicle according to the present invention, controls the amount of oil sent out from the operating oil supply source according to the operation amount of the operating device, so that a necessary amount of oil can be precisely supplied. Further, as opposed to the case of performing feedback control in which the flow rate of discharge from the operating oil supply source is determined based on the difference between operating oil pressure on the operating oil supply source side and operating oil pressure on the hydraulic actuator side, in control of the discharge flow rate, the occurrence of hunting and the degradation of responsivity can be suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTIONS OF THE DRAWINGS

The present invention will become more fully understood from the detailed description given herein below and the accompanying drawings which are given by way of illustration only and thus are not limitative of the present invention.

DESCRIPTION OF THE EMBODIMENTS

An embodiment of the present invention will be described below with reference to the drawings. The present embodiment describes a crawler type of hydraulic shovel (excavator) as an example working vehicle comprising an operation control device according to the present invention. First, the entire configuration of the hydraulic shovel 1 will be described principally with reference to FIG. 1.

Figure 1:
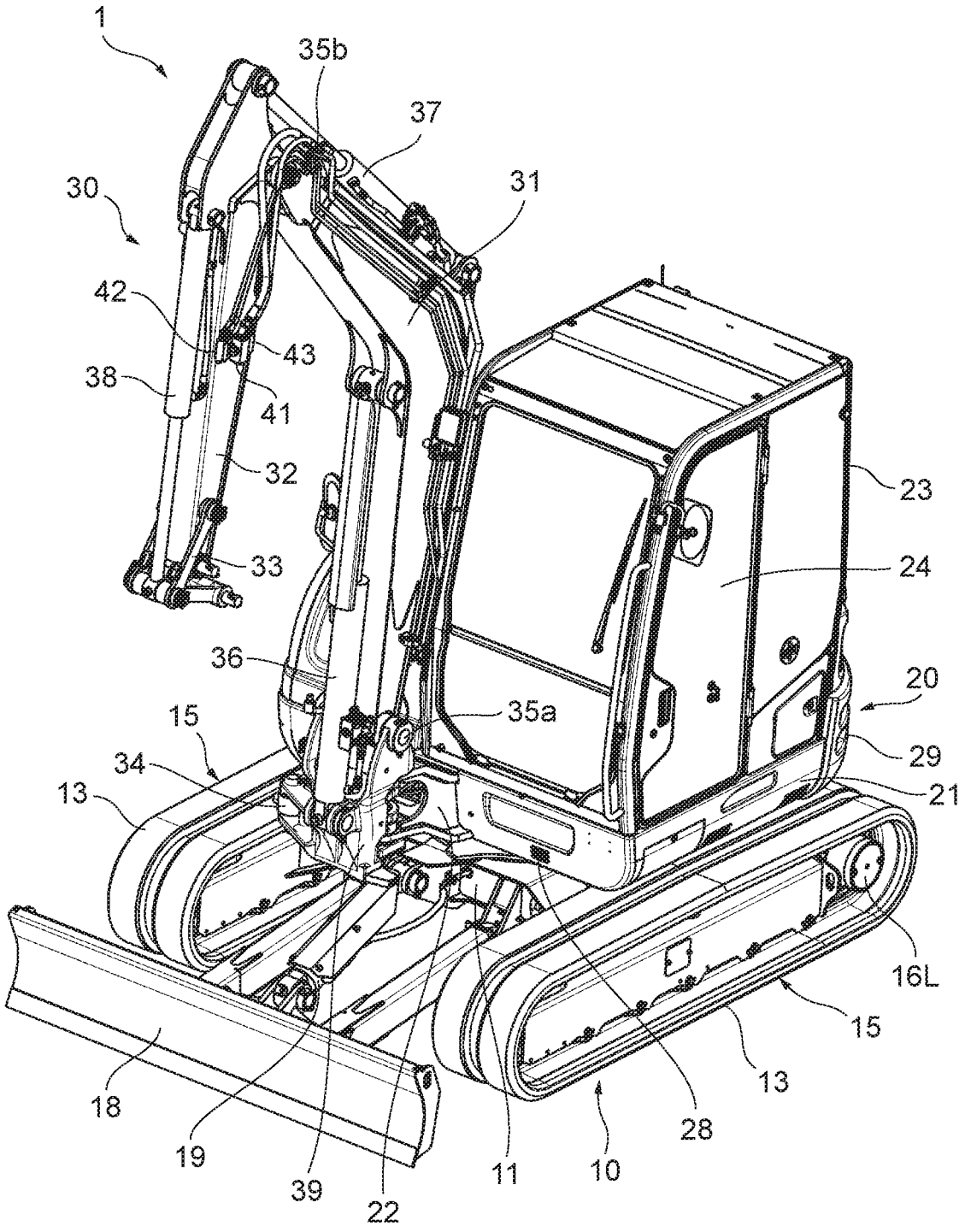
FIG. 1 is a perspective view of a hydraulic shovel comprising an operation control device according to the present invention.

The hydraulic shovel 1 is configured to comprise a movable traveling unit 10, a turning body 20 horizontally pivotally provided on the top of the traveling unit 10, and a shovel device 30 provided on the front of the turning body 20 as shown in FIG. 1. The traveling unit 10, the turning body 20, and the shovel device 30 are driven by hydraulic actuators.

The traveling unit 10 comprises a pair of left and right crawler mechanisms 15 on both right and left sides of a traveling unit frame 11 which each have a drive wheel, a plurality of slave wheels, and a crawler belt 13 placed around these wheels. The left and right crawler mechanisms comprise left and right traveling motors 16L, 16R (hydraulic actuators) to rotationally drive the drive wheels. The traveling unit 10 can travel in any direction and at any speed by controlling the rotational direction and rotational speed of the right and left traveling motors 16L, 16R. A blade 18 is vertically swingably provided on the front of the traveling unit frame 11. The blade 18 is vertically swingable by extending and contracting a blade cylinder 19 (a hydraulic actuator) provided across between the traveling unit frame 11 and the blade.

Figure 2:
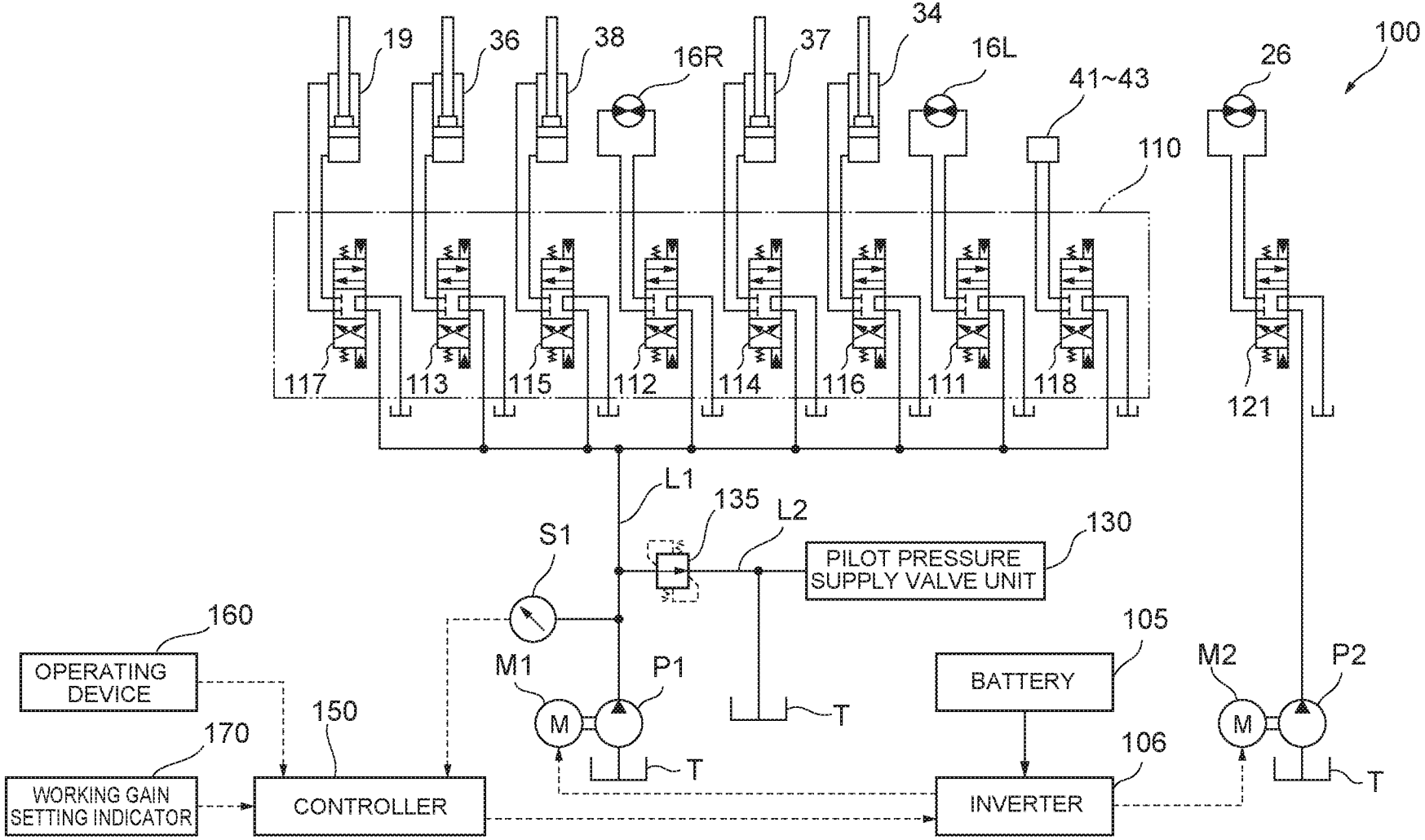
FIG. 2 is a hydraulic circuit diagram showing the operation control device according to the present invention.

A turning mechanism is provided in the center of the top of the traveling unit frame 11. This turning mechanism comprises an inner race fixed to the traveling unit frame 11, an outer race fixed to the turning body 20, a turning motor 26 (a hydraulic actuator, see FIG. 2) provided in the turning body 20, and a rotary center joint for supplying operating oil from a hydraulic pump provided in the turning body 20 to the right and left traveling motors 16L, 16R and blade cylinder 19 provided in the traveling unit 10. The turning body 20 is horizontally pivotally attached via this turning mechanism to the traveling unit frame 11 and is turnable in right and left directions with respect to the traveling unit 10 by operating the turning motor 26 to rotate normally or reversely. A main-body-side bracket 22 protruding forward is provided on the front of the turning body 20.

The shovel device 30 includes a boom bracket 39 attached to be swingable in right and left directions with a vertical axis as the center to the main-body-side bracket 22, a boom 31 attached to be vertically swingable (up/down movable) via a first swing pin 35*a* to the boom bracket 39, an arm 32 attached to be vertically swingable (bend/stretchable) via a second swing pin 35*b* to the tip of the boom 31, and a link mechanism 33 provided on the tip of the arm 32. The shovel device 30 further includes a swing cylinder 34 (a hydraulic actuator) provided across between the turning body 20 and the boom bracket 39, a boom cylinder 36 (a hydraulic actuator) provided across between the boom bracket 39 and the boom 31, an arm cylinder 37 (a hydraulic actuator) provided across between the boom 31 and the arm 32, and a bucket cylinder 38 (a hydraulic actuator) provided across between the arm 32 and the link mechanism 33.

The boom bracket 39 is swingable in right and left directions with respect to the turning body 20 (the main-body-side bracket 22) by operating the swing cylinder 34 to extend and contract. The boom 31 is swingable upward and downward (up/down movable) with respect to the main-body-side bracket 22 (the turning body 20) by operating the boom cylinder 36 to extend and contract. The arm 32 is swingable upward and downward (bend/stretchable) with respect to the boom 31 by operating the arm cylinder 37 to extend and contract.

Various attachments as hydraulic working devices such as a bucket, breaker, crusher, cutter, and auger device can be vertically swingably attached to the tip of the arm 32 and the link mechanism 33. The attachment attached to the tip of the arm 32 is vertically swingable with respect to the arm 32 via the link mechanism 33 by operating the bucket cylinder 38 to extend and contract. First to third attachment connection ports 41 to 43 to which can be connected a hydraulic hose for supplying operating oil to the hydraulic actuator of these attachments are provided on both left and right side surfaces of the arm 32.

The turning body 20 includes a turning frame 21 on the front of which the main-body-side bracket 22 is provided and an operator cabin 23 provided on the turning frame 21. The operator cabin 23 forms an operator room in a substantially rectangular box shape in which an operator can get and is provided at the left side with a cabin door 24 which can be laterally opened and closed. Inside the operator cabin 23, there are provided an operator seat on which the operator sits facing forward, a display device to display a variety of vehicle information of the hydraulic shovel 1, and various operation switches to be operated by the operator. Further, inside the operator cabin 23, there are provided an operating device 160 (see FIG. 2) which is operated to operate hydraulic actuators and a working gain setting indicator 170 (see FIG. 2) which is operated to set working speed gains of the hydraulic actuators. The operating device 160 has, as its operation portion to be operated by the operator, left and right travel operation levers or travel operation pedals (none are shown) with which to operate the traveling unit 10 to travel, left and right work operation levers 161, 162 (see FIG. 3) with which to operate the turning body 20 and the shovel device 30 to work, and a blade operation lever (not shown) with which to operate the blade 18 to work.

In the hydraulic shovel 1, an operator gets in the operator cabin 23 and inclines backward and forward in operation the left and right travel operation levers (or travel operation pedals), thereby making the left and right crawler mechanisms 15 (the left and right traveling motors 16L, 16R) drive according to the operation directions and operation amounts thereof, so that the hydraulic shovel 1 can be made to travel. Further, by inclining backward and forward, and right and left in operation the left and right work operation levers 161, 162, the turning body 20 and the shovel device 30 are made to drive according to the operation directions and operation amounts thereof, so that work such as excavation can be performed.

A horn device 28 is provided on the front of the turning frame 21. By pressing a horn switch in the operator cabin 23, a warning tone to call attention can be emitted from the horn device 28 to the vicinity of the hydraulic shovel 1. At the back of the turning frame body 20, a mounting chamber, in which the main part of an operation control device 100 described later is mounted, is provided behind the operator cabin 23. A counter weight 29 in a curved surface shape is provided to form the back wall of this mounting chamber.

The operation control device 100 comprises an operating oil tank T, a first hydraulic pump P1 to discharge operating oil for making the left and right traveling motors 16L, 16R and the like operate, a turning hydraulic pump P2 to discharge operating oil only for making the turning motor 26 operate, a control valve unit 110 to control the supply direction and flow rate of operating oil discharged from the first hydraulic pump P1 and supplied to the left and right traveling motors 16L, 16R and the like, a turn control valve 121 to control the supply direction of operating oil discharged from the turning hydraulic pump P2 and supplied to the turning motor 26, and a pilot pressure supply valve unit 130 to generate and supply pilot pressures for controlling the operation of the control valve unit 110 and the turn control valve 121 respectively.

The control valve unit 110 comprises control valves to control the supply/discharge, supply directions, and flow rates of operating oil supplied to the left and right traveling motors 16L, 16R, the boom cylinder 36, the arm cylinder 37, the bucket cylinder 38, the swing cylinder 34, the blade cylinder 19, and the first to third attachment connection ports 41 to 43 respectively. As these control valves, the unit 110 has left and right travel control valves 111, 112, a boom control valve 113, an arm control valve 114, a bucket control valve 115, a swing control valve 116, a blade control valve 117, and an attachment control valve 118. In each of these control valves 111 to 118, the incorporated spool is moved by a pilot pressure supplied from the pilot pressure supply valve unit 130, and by the movement of the spool, the supply/discharge, supply direction, and flow rate of operating oil supplied to each hydraulic actuator can be controlled.

In the turn control valve 121, as in the control valves 111 to 118, the incorporated spool is moved by a pilot pressure supplied from the pilot pressure supply valve unit 130. In the turn control valve 121, by the movement of the spool, only the supply/discharge and supply direction of operating oil supplied to the turning motor 26 are controlled to switch. The flow rate control of operating oil supplied to the turning motor 26 (that is, the turn speed control of the turning body 20) is performed by the rotation control of a second electric motor M2 described later.

The pilot pressure supply valve unit 130 is provided in a branch oil passage L2 branching off from a pump oil passage L1 leading from the discharge port of the first hydraulic pump P1 to the control valve unit 110. In the branch oil passage L2, a check valve 135 to keep oil pressure necessary for the pilot pressure supply valve unit 130 to generate pilot pressures is provided. With use of operating oil discharged from the first hydraulic pump P1, the pilot pressure supply valve unit 130 generates pilot pressures according to the respective operation directions and operation amounts of the travel operation levers (travel operation pedals), the work operation levers 161, 162, and the blade operation lever provided in the operator cabin 23 and supplies to the corresponding control valves. The pilot pressure supply valve unit 130 has a plurality of electromagnetic proportional pilot pressure supply valves (described in detail later) for supplying the pilot pressures to the corresponding control valves.

The operation control device 100 further comprises a first electric motor M1 to drive the first hydraulic pump P1, the second electric motor M2 to drive the turning hydraulic pump P2, a battery 105 (a storage battery) rechargeable from an external power supply or the like, an inverter 106 that converts DC power from the battery 105 into AC power to change frequency and the magnitude of voltage, a first pressure sensor S1 to detect the pressure (pump pressure) of operating oil discharged from the first hydraulic pump P1, a controller 150 to perform a variety of control (described in detail later), the above-mentioned operating device 160, and the working gain setting indicator 170.

The first and turning hydraulic pumps P1, P2 are each a fixed-capacity-type hydraulic pump and discharge operating oil of flow rates according to the output of the first and second electric motors M1, M2.

Figure 3:
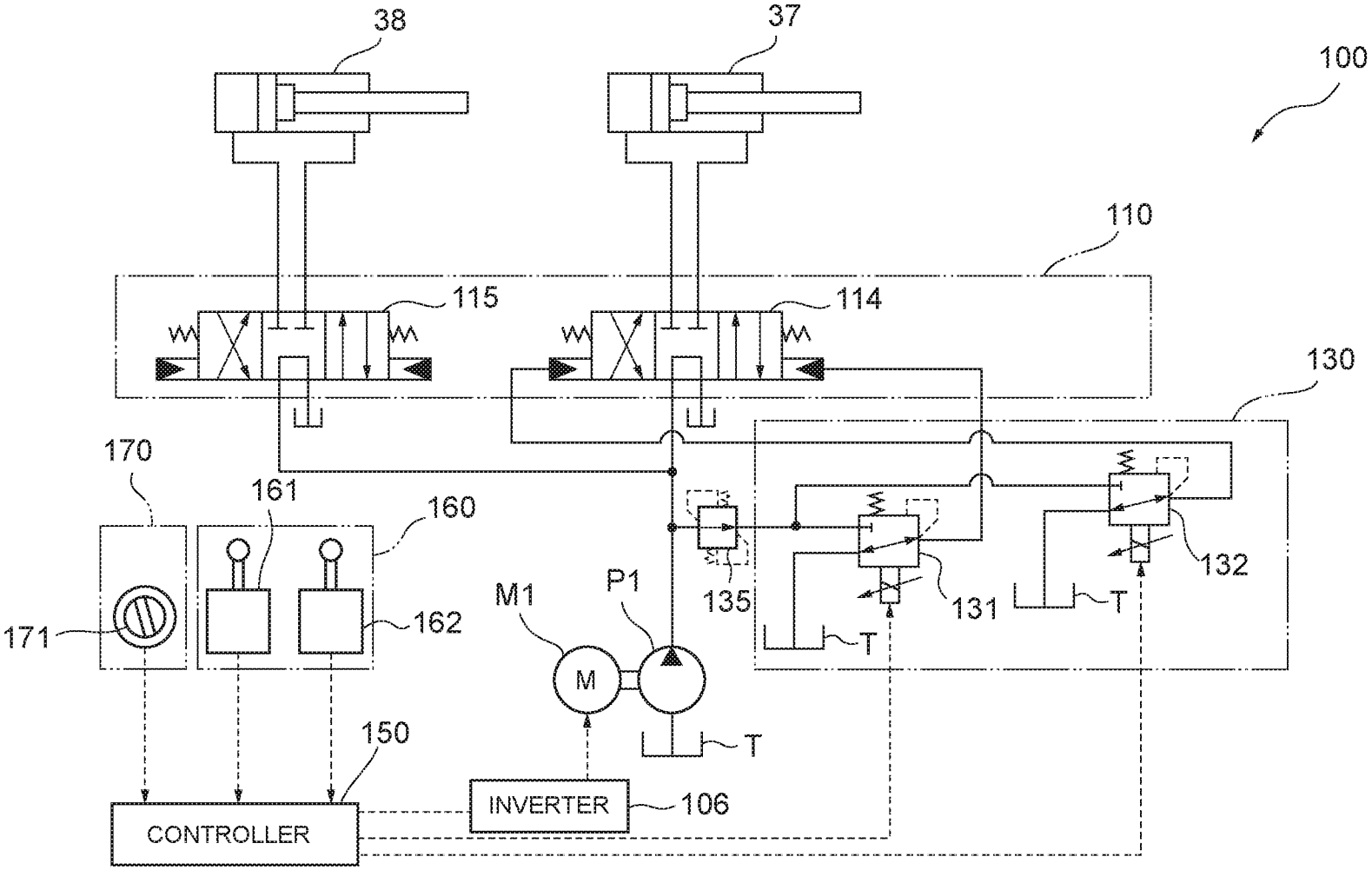
FIG. 3 is a hydraulic circuit diagram for explaining the control content when a controller in the operation control device performs operation control of an arm cylinder and a bucket cylinder.
Figure 4:
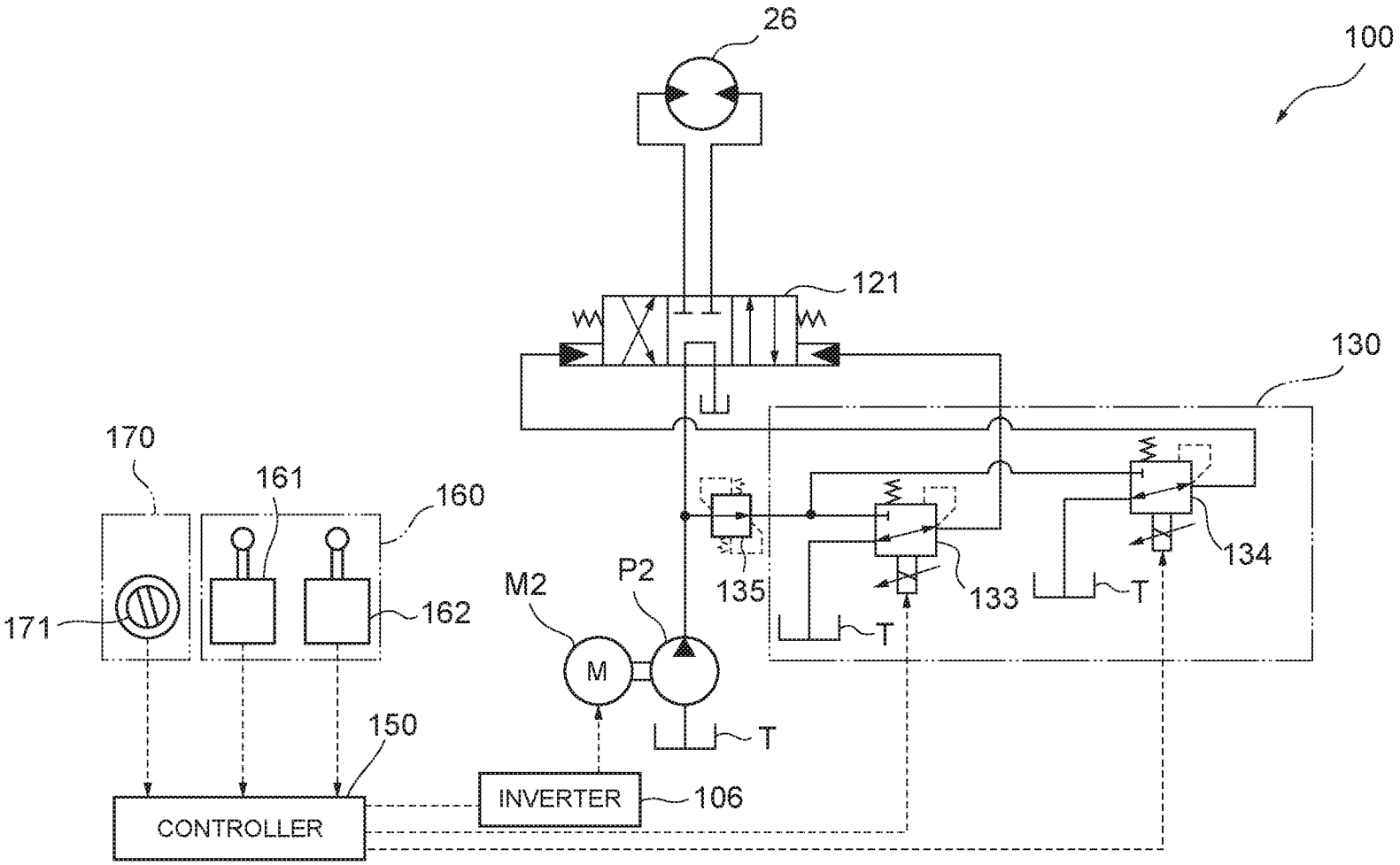
FIG. 4 is a hydraulic circuit diagram for explaining the control content when the controller performs operation control of a turning motor.

Next, the contents of control by the controller 150 will be described. FIG. 3 is a hydraulic circuit diagram for explaining the control content when the controller 150 performs operation control of the arm cylinder 37 and the bucket cylinder 38. FIG. 4 is a hydraulic circuit diagram for explaining the control content when the controller 150 performs operation control of the turning motor 26. Components necessary for explaining the control content are extracted and shown in FIGS. 3 and 4. In the description below, the left and right traveling motors 16L, 16R, the boom cylinder 36, the arm cylinder 37, the bucket cylinder 38, the swing cylinder 34, and the blade cylinder 19, of which the operation control is performed via the control valve unit 110, are collectively called working hydraulic actuators. Although FIG. 3 shows, as the control valve unit 110, only the portion which performs the operation control of the arm cylinder 37 and the bucket cylinder 38, the control valve unit 110 has control valves that perform the operation control of all the working hydraulic actuators.

FIGS. 3 and 4 show the left and right work operation levers 161, 162 as the operation portion of the operating device 160. The work operation levers 161, 162 are joystick-type operation levers and output operation output signals corresponding to the operation thereof to the controller 150. Specifically, the left work operation lever 161, when operated backward and forward, outputs an operation output signal to make the arm cylinder 37 operate and, when operated rightward and leftward, outputs an operation output signal to make the turning motor 26 operate. In contrast, the right work operation lever 162, when operated backward and forward, outputs an operation output signal to make the boom cylinder 36 operate and, when operated rightward and leftward, outputs an operation output signal to make the bucket cylinder 38 operate. The work operation levers 161, 162 are configured to output an operation output signal according to the operation amount (operation stroke) thereof, which signal becomes higher in signal level (e.g., in voltage value or current value) as the operation amount becomes larger. Likewise, the other operation levers (operation pedals) omitted from illustration in FIGS. 3 and 4 output an operation output signal of a signal level according to the operation amount to make a corresponding hydraulic actuator operate to the controller 150. Note that, in this example, each operation lever has the same configuration and that, when the operation amount of each operation lever is the same, the signal levels of the respective operation output signals are also the same.

The working gain setting indicator 170 has a hold operation portion 171 that the operator, holding with fingers, can rotate in operation within a predetermined angular range and is configured to output a working gain indicating signal corresponding to the operation amount (rotation angular position) of the hold operation portion 171 to the controller 150. The working gain signal is an indicating signal to have the controller 150 set a working speed gain described later. The controller 150 sets the working speed gain according to this working speed gain signal (described in detail later).

The arm control valve 114 shown in FIG. 3, with the movement position of the incorporated spool being controlled by pilot pressures supplied from pilot pressure supply valves 131, 132 in the pilot pressure supply valve unit 130, controls the supply direction and flow rate of operating oil supplied to the arm cylinder 37. The pilot pressure supply valves 131, 132 are electromagnetic proportional pilot pressure control valves and are operated by pilot pressure control signals from the controller 150 to control the pilot pressures supplied to the arm control valve 114. The pilot pressure from the pilot pressure supply valve 131 acts to move the spool of the arm control valve 114 leftward. The pilot pressure from the pilot pressure supply valve 132 acts to move the spool of the arm control valve 114 rightward. By controlling the pilot pressures from the pilot pressure supply valves 131, 132, the movement direction and movement position (opening degree) of the spool of the arm control valve 114 are controlled. By this means, the supply/discharge, supply direction, and flow rate of operating oil supplied from the arm control valve 114 to the arm cylinder 37 can be controlled. In the pilot pressure supply valve unit 130, pilot pressure supply valves to supply pilot pressures to the bucket control valve 115 and the other working hydraulic actuators are also provided. These pilot pressure supply valves are the same in configuration and action as the pilot pressure supply valves 131, 132.

The turn control valve 121 shown in FIG. 4, with the movement position of the incorporated spool being switched between the middle position, right-side position, and left-side position by pilot pressures supplied from pilot pressure supply valves 133, 134 in the pilot pressure supply valve unit 130, controls the supply direction of operating oil supplied to the turning motor 26. The pilot pressure supply valves 133, 134 are operated by pilot pressure control signals from the controller 150 to switch between the state of supplying the pilot pressure to the turning motor 26 (called an on state) and the state of not supplying (called an off state). When the pilot pressure supply valve 133 is put in the on state to supply the pilot pressure, the spool of the turn control valve 121 moves leftward by this pilot pressure, so that the movement position of the spool is switched to the left-side position. When the pilot pressure supply valve 134 is put in the on state to supply the pilot pressure, the spool of the turn control valve 121 moves rightward by this pilot pressure, so that the movement position of the spool is switched to the right-side position. By controlling the operation of the pilot pressure supply valves 133, 134 in this way, the pilot pressures supplied to the turn control valve 121 are controlled. By this means, the movement position of the spool of the turn control valve 121 is switched, so that the supply/discharge and supply direction of operating oil supplied from the turn control valve 121 to the turning motor 26 are controlled.

The hold operation portion 171 of the working gain setting indicator 170 is rotated in operation by the operator, so that the controller 150 sets and adjusts the working speed gain. The working speed gain is set as a parameter (e.g., a coefficient) determining the correspondence relation between the operation amount of an operation lever in the operating device 160 and the working speed of the corresponding hydraulic actuator (the supply flow rate of operating oil supplied to the hydraulic actuator). By changing the setting of the working speed gain according to the rotation angular position of the hold operation portion 171, the flow rate of supply to the hydraulic actuator (the working speed thereof) for the same operation amount can be adjusted.

Figure 5:
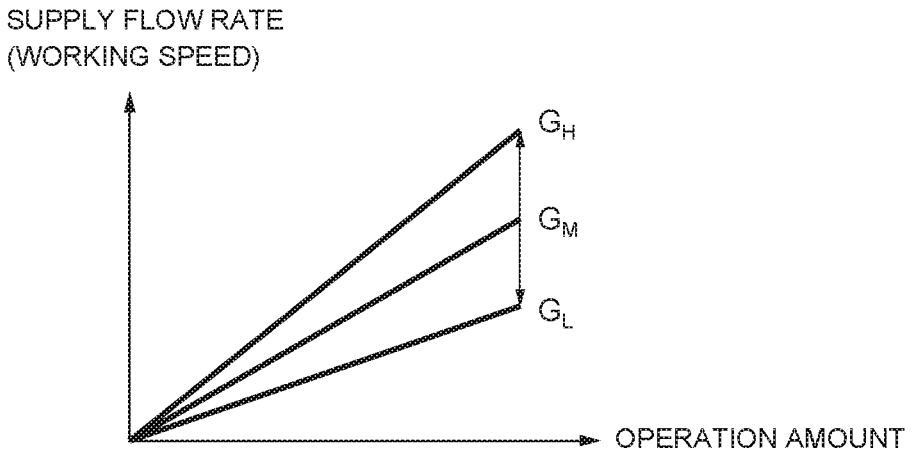
FIG. 5 is a graph schematically showing the way that the correspondence relation between the operation amount of an operation lever and a supply flow rate changes based on a working speed gain.

FIG. 5 schematically represents the way that the correspondence relation between the operation amount of the operation portion and the amount of oil supplied to the actuator changes as the setting of the working speed gain becomes different. $G_L$, $G_H$, $G_M$ shown in FIG. 5 are respectively the minimum value, maximum value, and middle value of the working speed gain within the settable value range. The working speed gain can be set at any value greater than or equal to $G_L$ and smaller than or equal to $G_H$ according to the rotation angular position of the hold operation portion 171. As shown in FIG. 5, by changing the working speed gain, the flow rate of supply to the hydraulic actuator (the working speed of the hydraulic actuator) for the same operation amount changes. Hence, adjustment can be made in which when the working speed of the hydraulic actuator for the same operation amount is desired to become faster, the working speed gain is set higher and in which conversely when desired to become slower, the working speed gain is set lower. Note that the specific value of the working speed gain is set as needed for each hydraulic actuator. For example, as to the working speed gain for the arm cylinder 37, setting is made such that $G_L$=0.8, $G_M$=1.0, $G_H$=1.2; as to the working speed gain for the bucket cylinder 38, setting is made such that $G_L$=0.5, $G_M$=0.75, $G_H$=1.0; and so on, as such, they can also be set at values different for each actuator.

The contents of the working speed control of hydraulic actuators by the controller 150 will be specifically described below. First, description will be made taking as an example the case where the arm cylinder 37 shown in FIG. 3 is made to operate alone. Note that the rotation of the first electric motor M1 is controlled according to the operation of the operation lever so as to control the flow rate of discharge from the first hydraulic pump P1, which will be described later. The controller 150 generates and outputs pilot pressure control signals based on the operation output signal from the left work operation lever 161 operated to make the arm cylinder 37 operate and the working gain indicating signal from the working gain setting indicator 170. The pilot pressure supply valves 131, 132 adjust pilot pressures according to these pilot pressure control signals. As the method of generating pilot pressure control signals based on the operation output signal and the working gain indicating signal in this case, the following two methods will be described with further reference to FIGS. 6 and 7.

<Method X1>

Figure 6:
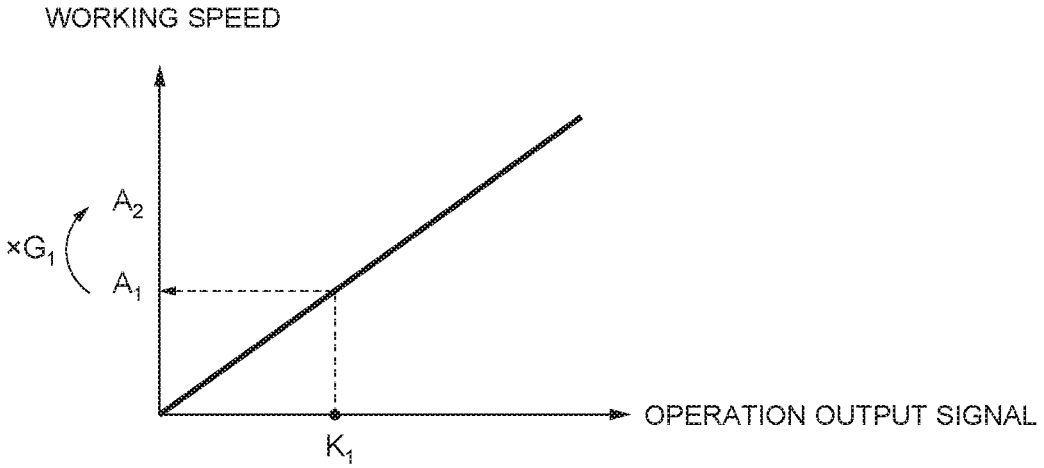
FIG. 6 is a graph illustrating the correspondence relation between the signal level of an operation output signal and working speed.

In the first method X1, the controller 150 detects the operation output signal from the operating device 160 (here the work operation lever 161) and obtains the working speed $A_1$ (called a basic working speed) of a hydraulic actuator (here the arm cylinder 37) corresponding to the signal level (denoted as, e.g., $K_1$) of the detected operation output signal. Specifically, for example, as shown in FIG. 6, the correspondence relation between the signal level of the operation output signal and the working speed when the working gain indicating signal from the working gain setting indicator 170 is not taken into account (e.g., in the case of the working speed gain=1.0) is obtained beforehand by simulation or the like based on design values, and the working speed $A_1$ is obtained based on this correspondence relation. Although FIG. 6 represents a linear correspondence relation as the correspondence relation between the operation output signal and the working speed, in reality, such a correspondence relation is set that a desired performance characteristic is obtained. This correspondence relation is often non-linear.

Next, the controller 150 sets the working speed gain $G_1$ corresponding to the detected working gain indicating signal. The working speed gain has a value corresponding to the rate at which to increase/decrease the working speed (the gain or attenuation rate) or the increase/decrease amount and is set according to the operation of the operator. For example, when the hold operation portion 171 of the working gain setting indicator 170 is operated to the leftmost rotation angular position within the rotation-allowable angle range thereof, the working speed gain is set at the smallest value $G_L$ (e.g., 0.8). When the hold operation portion 171 is operated to the rightmost rotation angular position, the working speed gain is set at the largest value $G_H$ (e.g., 1.2). $G_1$ is a working speed gain value satisfying $G_L \leq G_1 \leq G_H$.

After setting the working speed gain $G_1$, the controller 150 couples the working speed gain $G_1$ to the working speed $A_1$ to obtain a gain corrected working speed $A_2$. For example, the value of the working speed $A_1$ multiplied by the value of the working speed gain $G_1$ is taken as the value of the gain corrected working speed $A_2$ (see FIG. 6). If the working speed gain $G_1$ is smaller than 1.0, the gain corrected working speed $A_2$ is a speed smaller (slower) than the working speed $A_1$ and, if the working speed gain $G_1$ is greater than 1.0, is a speed greater (faster) than the working speed $A_1$. When the gain corrected working speed $A_2$ is determined, the necessary flow rate (necessary supply flow rate) for making it operate at the gain corrected working speed $A_2$ is determined from the characteristic of the hydraulic actuator (arm cylinder 37). When the necessary supply flow rate is determined, the valve opening degree for supplying at the necessary supply flow rate is determined from the characteristic of the control valve (here the control valve 114), and the pilot pressures for achieving that valve opening degree can be obtained. The controller 150 outputs pilot pressure control signals to the inverter 106 to supply the obtained pilot pressures to the control valve.

By these pilot pressure control signals, the operation of the pilot pressure supply valves 131, 132 is controlled, so that pilot pressures supplied from the pilot pressure supply valves 131, 132 to the arm control valve 114 are controlled. And the movement direction and movement position (opening degree) of the spool of the arm control valve 114 are controlled by these pilot pressures, and by this means, the flow rate of operating oil supplied from the arm control valve 114 to the arm cylinder 37 is controlled, so that the working speed of the arm cylinder 37 is controlled. That is, according to the method X1, the pilot pressures supplied to the control valve 114 are controlled based on the operation output signal from the left work operation lever 161 and the working gain indicating signal from the working gain setting indicator 170, and by this control of the pilot pressures, the working speed of the arm cylinder 37 is controlled. Specifically, with the same operation amount, when the working speed gain value is greater than 1.0, the working speed is faster than when the working speed gain value is 1.0, and when the working speed gain value is smaller than 1.0, the working speed is slower than when the working speed gain value is 1.0. By making the working speed gain value larger, the working speed of the hydraulic actuator (arm cylinder 37) can be raised, and by making the working speed gain value smaller, the working speed can be lowered. Thus, the working speed of the hydraulic actuator for the same operation amount can be adjusted as needed according to the work content or so on to perform work.

<Method X2>

In the second method X2, the controller 150 detects the operation output signal from the operating device 160 (the work operation lever 161) and the working gain indicating signal from the working gain setting indicator 170. Then the working speed gain $G_1$ ($G_L \leq G_1 \leq G_H$) corresponding to the detected working gain indicating signal (the rotation angular position of the hold operation portion 171 of the working gain setting indicator 170) is set.

Then the controller 150 multiplies the detected operation output signal by the working speed gain $G_1$ to obtain a corrected operation output signal. For example, the operation output signal of a signal level $K_1$ is multiplied by the working speed gain $G_1$ to obtain a corrected operation output signal of a signal level $K_2$. The controller 150 outputs a pilot pressure control signal corresponding to the obtained corrected operation output signal to a pilot pressure supply valve (a corresponding one of the pilot pressure supply valves 131, 132).

By this pilot pressure control signal, as in the method X1, the operation of the pilot pressure supply valves 131, 132 is controlled, so that the pilot pressures supplied from the pilot pressure supply valves 131, 132 to the control valve 114 are controlled. Then by these the pilot pressures, the movement direction and movement position (opening degree) of the spool of the arm control valve 114 are controlled, and by this means, the flow rate of operating oil supplied from the arm control valve 114 to the arm cylinder 37 is controlled, so that the working speed of the arm cylinder 37 is controlled. That is, also with the method X2, the pilot pressures supplied to the control valve 114 are controlled based on the operation output signal from the left work operation lever 161 and the working gain indicating signal from the working gain setting indicator 170, and by this control of the pilot pressures, the working speed of the arm cylinder 37 is controlled.

Figure 7:
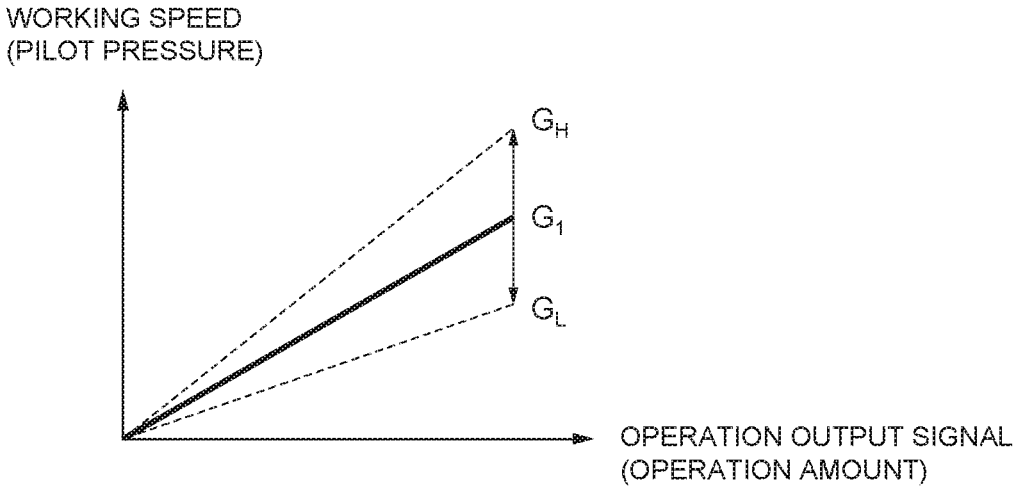
FIG. 7 is a graph schematically showing the way that pilot pressure and the working speed of a working hydraulic actuator change based on the operation output signal and the working speed gain.

Although the above description has been made taking as an example the case where the working speed of the arm cylinder 37 is controlled, also in the case where the working speed of another working hydraulic actuator is controlled, control that is the same in content as the above control is performed. FIG. 7 schematically represents the way that the pilot pressure from a pilot pressure supply valve and the working speed of a working hydraulic actuator change based on the operation output signal (the operation amount of the operation lever or the like) and the working speed gain. As shown in FIG. 7, as the working speed gain becomes smaller, the ratio of change in the working speed (pilot pressure) of the working hydraulic actuator to change in the operation output signal (operation amount) becomes smaller. Hence, by setting the working speed gain to be smaller than, e.g., 1.0, the working speed of the working hydraulic actuator for the operation amount is made slower, and thus delicate work in which the working hydraulic actuator is made to operate at very slow speed can be precisely performed.

Next, the content of the working speed control in the case where the turning motor 26 shown in FIG. 4 is made to operate will be described. The controller 150 generates and outputs a rotational frequency control signal based on the operation output signal from the left work operation lever 161 operated to make the turning motor 26 operate and the working gain indicating signal from the working gain setting indicator 170. The second electric motor M2 adjusts the rotational frequency according to this rotational frequency control signal. As the method of generating the rotational frequency control signal based on the operation output signal and the working gain indicating signal in this case, the following two methods will be described with further reference to FIG. 8. For simplicity of description, FIG. 6, which can be applied to the working speed control of the turning motor 26, is referred to below.

<Method Y1>

In the first method Y1, when the operation lever (here the work operation lever 161) is operated, the controller 150 detects the operation output signal from the operating device 160 and outputs a pilot pressure control signal to a pilot pressure supply valve. By this pilot pressure control signal, the pilot pressure supply valve (a corresponding one of the pilot pressure supply valves 131, 132) is switched from the off state to the on state. Further, thereby the opening degree of the turn control valve 121 is switched to a fully-open state. The controller 150 obtains the working speed $A_1$ (corresponding to the basic working speed) of a hydraulic actuator (here the turning motor 26) corresponding to the signal level (denoted as, e.g., $K_1$) of the operation output signal from the operating device 160. For example, as in the above method X1, the correspondence relation between the signal level of the operation output signal and the working speed when the working gain indicating signal from the working gain setting indicator 170 is not taken into account (e.g., in the case of the working speed gain=1.0) is obtained beforehand, and the working speed $A_1$ is obtained based on this correspondence relation (see FIG. 6).

Next, the controller 150 detects the working gain indicating signal from the working gain setting indicator 170 and the working speed gain $G_1$ corresponding to the detected working gain indicating signal is set. After setting the working speed gain $G_1$, the controller 150 couples the working speed gain $G_1$ to the working speed $A_1$ to obtain a gain corrected working speed $A_2$. For example, as in the above method X1, the value of the working speed $A_1$ multiplied by the value of the working speed gain $G_1$ is taken as the value of the gain corrected working speed $A_2$ (see FIG. 6).

When the gain corrected working speed $A_2$ is determined, the supply flow rate necessary for making it operate at the gain corrected working speed $A_2$ is determined from the characteristic of the hydraulic actuator (turning motor 26). When the necessary supply flow rate is determined, the rotational frequency of the second electric motor M2 for supplying at the necessary supply flow rate can be obtained from the characteristics of the second electric motor M2 and the second hydraulic pump P2. The controller 150 outputs the rotational frequency control signal to the inverter 106 for the second electric motor M2 to operate at the obtained rotational frequency.

The inverter 106, having received this rotational frequency control signal, controls the rotational frequency of the second electric motor M2, and by this rotational frequency control, the flow rate of discharge from the turning hydraulic pump P2 is controlled. Where the rotational frequency control of the second electric motor M2 is performed, one of the pilot pressure supply valves 133, 134 is put in the on state, so that a pilot pressure is supplied to the turn control valve 121. By this means, the movement position of the spool of the turn control valve 121 is switched to the right-side position or the left-side position. Hence, the flow rate of operating oil supplied from the turn control valve 121 to the turning motor 26 is determined by the flow rate of discharge from the turning hydraulic pump P2, that is, the rotational frequency of the second electric motor M2. That is, according to the method Y1, the rotational frequency of the second electric motor M2 is controlled based on the operation output signal from the work operation lever 161 and the working gain indicating signal from the working gain setting indicator 170, and by this control of the rotational frequency of the second electric motor M2, the working speed of the turning motor 26 is controlled. Specifically, with the same operation amount, when the working speed gain value is greater than 1.0, the working speed is faster than when the working speed gain value is 1.0, and when the working speed gain value is smaller than 1.0, the working speed is slower than when the working speed gain value is 1.0. By making the working speed gain value larger, the working speed of the hydraulic actuator (turning motor 26) can be raised, and by making the working speed gain value smaller, the working speed can be lowered. Thus, the working speed of the hydraulic actuator for the same operation amount can be adjusted as needed according to the work content or so on to perform work.

<Method Y2>

In the second method Y2, when an operation lever (here the work operation lever 161) is operated, the controller 150 detects the operation output signal from the operating device 160 and outputs a pilot pressure control signal to a pilot pressure supply valve. By this pilot pressure control signal, the pilot pressure supply valve (a corresponding one of the pilot pressure supply valves 133, 134) is switched from the off state to the on state. Further, thereby the opening degree of the turn control valve 121 is switched to a fully-open state. The controller 150 detects the working gain indicating signal from the working gain setting indicator 170 and the working speed gain $G_1$ corresponding to the detected working gain indicating signal is set.

Next, the controller 150 multiplies the detected operation output signal by the working speed gain $G_1$ to obtain a corrected operation output signal. For example, the operation output signal of a signal level $K_1$ is multiplied by the working speed gain $G_1$ to obtain a corrected operation output signal of a signal level $K_2$. The controller 150 outputs a rotational frequency control signal corresponding to the obtained corrected operation output signal to the inverter 106.

The inverter 106, having received this rotational frequency control signal, controls the rotational frequency of the second electric motor M2, and by this rotational frequency control, the flow rate of discharge from the turning hydraulic pump P2 is controlled. As in the method Y1, where the rotational frequency control of the second electric motor M2 is performed, one of the pilot pressure supply valves 133, 134 is put in the on state, so that a pilot pressure is supplied to the turn control valve 121. By this means, the movement position of the spool of the turn control valve 121 is switched to the right-side position or the left-side position. Hence, the flow rate of operating oil supplied from the turn control valve 121 to the turning motor 26 is determined by the flow rate of discharge from the turning hydraulic pump P2, that is, the rotational frequency of the second electric motor M2. That is, also in the method Y2, the rotational frequency of the second electric motor M2 is controlled based on the operation output signal from the work operation lever 161 and the working gain indicating signal from the working gain setting indicator 170, and by this control of the rotational frequency of the second electric motor M2, the working speed of the turning motor 26 is controlled.

Figure 8:
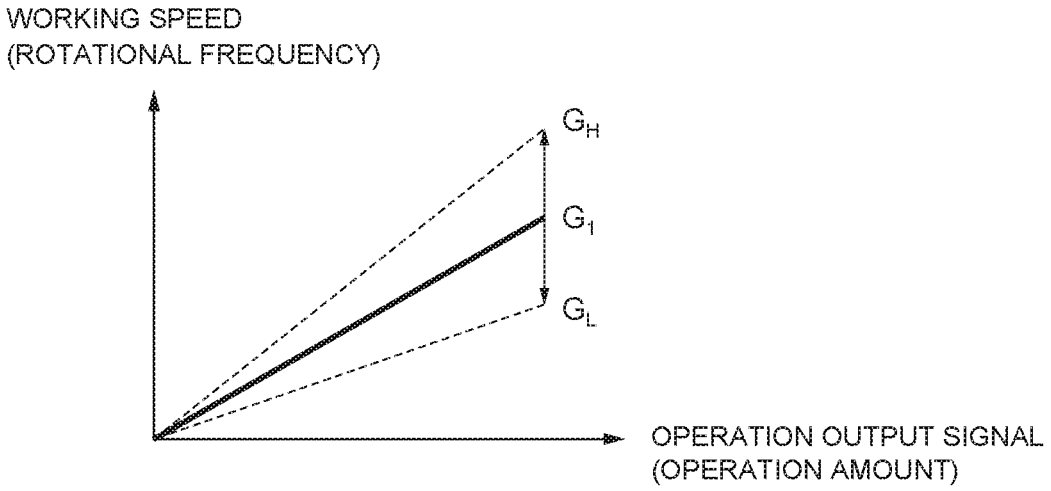
FIG. 8 is a graph schematically showing the way that the rotational frequency of a second electric motor and the working speed of a turning motor change based on the operation output signal and the working speed gain.

FIG. 8 schematically represents the way that the rotational frequency of the second electric motor M2 and the working speed of the turning motor 26 change based on the operation output signal (the operation amount of the operation lever 161) and the working speed gain. As shown in FIG. 8, as the working speed gain becomes smaller, the ratio of change in the working speed (the rotational frequency of the second electric motor M2) of the turning motor 26 to change in the operation output signal (operation amount) becomes smaller. Hence, by setting the working speed gain to be smaller than, e.g., 1.0, the working speed of the turning motor 26 for the operation amount is made slower, and thus delicate work in which the turning body 20 is made to turn at very slow speed can be precisely performed.

As such, the controller 150 is configured to be able to set together the working speed gains of the working hydraulic actuators and the turning motor 26 for the operation of the operation levers of the operating device 160 according to the rotation angular position of the hold operation portion 171 of the working gain setting indicator 170. Thus, the operator, only by rotating in operation the hold operation portion 171 of the working gain setting indicator 170, can easily set and adjust the working speed characteristics of the hydraulic actuators for the operation amounts of the operation levers at one time.

Next, the control of the flow rate of discharge from the first hydraulic pump P1 shown in FIG. 3 will be described with further reference to FIGS. 9 and 10. In general, by feedback control in which the flow rate of discharge from the hydraulic pump P1 is determined based on the difference between operating oil pressure on the hydraulic pump P1 side and operating oil pressure on the working hydraulic actuator side, the flow rate of discharge from the hydraulic pump P1 is controlled. However, if the flow rate of discharge from the hydraulic pump P1 is controlled by this feedback control, control responsivity is relatively slow. Thus, there is concern that during the control of the flow rate of discharge from the first hydraulic pump P1, in the situation where the differential pressure abruptly changes, a control delay occurs, so that hunting is likely to occur and that in the situation where the differential pressure changes only slightly, the responsivity is likely to be poor. Accordingly, in the operation control device 100, the controller 150 controls the flow rate of discharge from the first hydraulic pump P1 as follows.

If the arm cylinder 37 is made to operate alone, the controller 150 controls the rotational frequency of the first electric motor M1 according to the signal level (the operation amount of the work operation lever 161) of the operation output signal (called a first operation output signal) from the left work operation lever 161 operated to make the arm cylinder 37 operate. Specifically, the controller 150 controls the rotational frequency of the first electric motor M1 such that as the signal level (the operation amount of the work operation lever 161) of the first operation output signal becomes larger, the flow rate of discharge from the first hydraulic pump P1 increases and that a flow of the discharge flow rate necessary for making the arm cylinder 37 operate at a working speed corresponding to the signal level of the first operation output signal is discharged from the first hydraulic pump P1. For example, as shown in FIG. 9, the correspondence relation between the signal level of the first operation output signal and the rotational frequency of the first electric motor M1 for obtaining the necessary discharge flow rate is obtained beforehand by simulation or the like based on design values, and the rotational frequency (called a necessary rotational frequency) of the first electric motor M1 is obtained based on this correspondence relation. Then a rotational frequency control signal is outputted to the inverter 106 to achieve the obtained necessary rotational frequency so as to control the rotational frequency of the first electric motor M1. The first electric motor M1 rotates at the necessary rotational frequency, so that a flow of the necessary discharge flow rate for making the arm cylinder 37 operate is discharged from the first hydraulic pump P1. In this case, operating oil discharged from the first hydraulic pump P1 is supplied to the arm cylinder 37 via the control valve 114. An opening characteristic such as the opening area corresponding to the valve opening degree is set beforehand such that, by its opening degree being controlled according to the operation amount of the work operation lever 161, the control valve 114 can supply to the arm cylinder 37 at the necessary supply flow rate for making the arm cylinder 37 operate at the working speed corresponding to the operation amount. The necessary discharge flow rate of the flow discharged from the first hydraulic pump P1 is set to be larger than the necessary supply flow rate of the flow supplied from the control valve 114 to the arm cylinder 37 (such that oil pressure on the inflow side of the control valve 114 is higher than that on the outflow side).

If the bucket cylinder 38 is made to operate alone, the controller 150 controls the rotational frequency of the first electric motor M1 according to the signal level (operation amount) of the operation output signal (called a second operation output signal) from the right work operation lever 162. Specifically, the controller 150 controls the rotational frequency of the first electric motor M1 such that as the signal level (the operation amount of the work operation lever 162) of the second operation output signal becomes larger, the flow rate of discharge from the first hydraulic pump P1 increases and that a flow of the discharge flow rate necessary for making the bucket cylinder 38 operate at a working speed corresponding to the signal level of the second operation output signal is discharged from the first hydraulic pump P1. For example, as shown in FIG. 10, the correspondence relation between the signal level of the second operation output signal and the rotational frequency of the first electric motor M1 for obtaining the necessary discharge flow rate is obtained beforehand, and the necessary rotational frequency of the first electric motor M1 is obtained based on this correspondence relation. Then a rotational frequency control signal is outputted to the inverter 106 to achieve the obtained necessary rotational frequency so as to control the rotational frequency of the first electric motor M1. The first electric motor M1 rotates at the necessary rotational frequency, so that a flow of the necessary discharge flow rate for making the bucket cylinder 38 operate is discharged from the first hydraulic pump P1. In this case, operating oil discharged from the first hydraulic pump P1 is supplied to the bucket cylinder 38 via the control valve 115. An opening characteristic such as the opening area corresponding to the valve opening degree is set beforehand such that, by its opening degree being controlled according to the operation amount of the work operation lever 162, the control valve 115 can supply to the bucket cylinder 38 at the necessary supply flow rate for making the bucket cylinder 38 operate at the working speed corresponding to the operation amount. The necessary discharge flow rate of the flow discharged from the first hydraulic pump P1 is set to be larger than the necessary supply flow rate of the flow supplied from the control valve 115 to the bucket cylinder 38 (such that oil pressure on the inflow side of the control valve 115 is higher than that on the outflow side).

Figure 9:
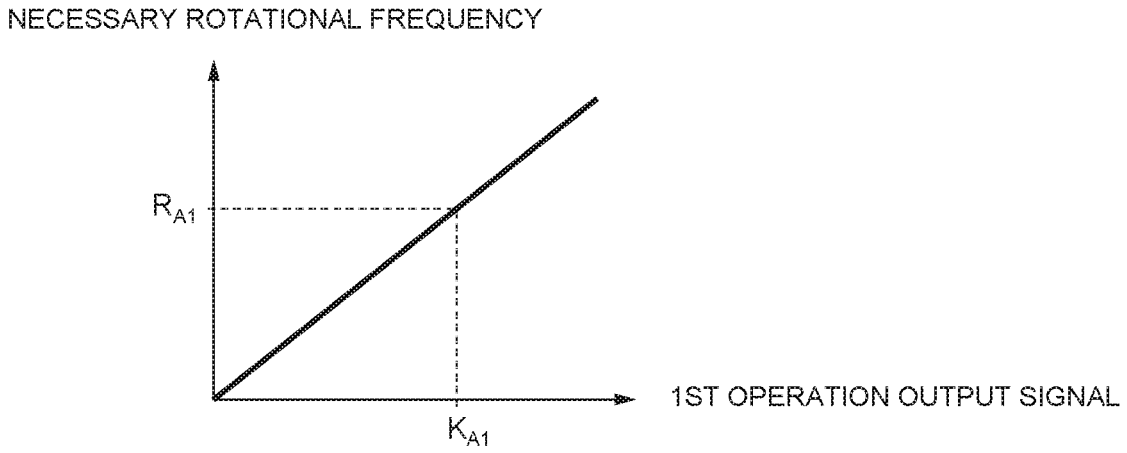
FIG. 9 is a graph illustrating the correspondence relation between a first operation output signal and necessary rotational frequency.
Figure 10:
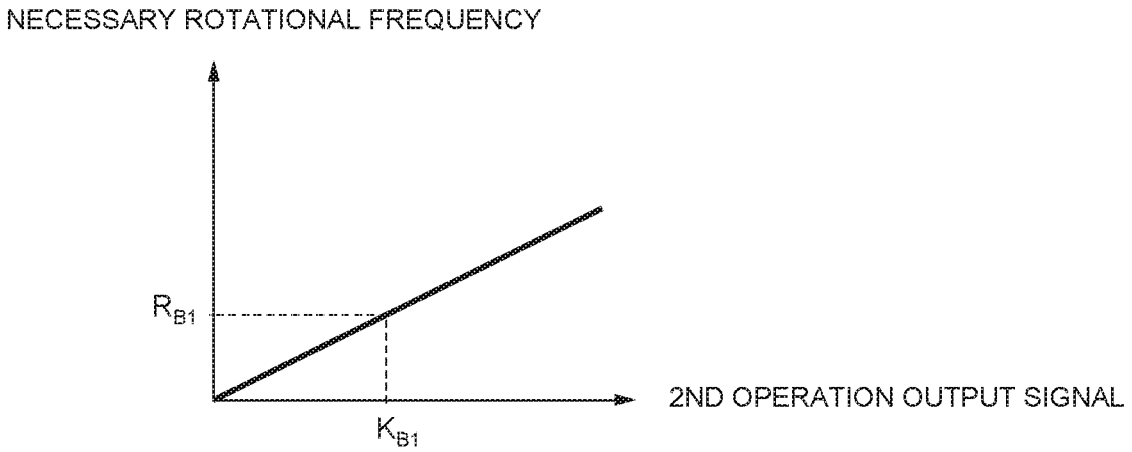
FIG. 10 is a graph illustrating the correspondence relation between a second operation output signal and necessary rotational frequency.

Although FIGS. 9 and 10 represent a linear correspondence relation as the correspondence relation between the signal level of the operation output signal and the necessary rotational frequency, in reality, such a correspondence relation is set that a desired performance characteristic is obtained. This correspondence relation is often non-linear. The necessary discharge flow rate (necessary rotational frequency) for the signal level of the operation output signal (the operation amount of the work operation lever) is called a necessary discharge flow rate-operation amount ratio. This necessary discharge flow rate-operation amount ratio is determined by characteristics of the hydraulic actuator made to operate, the control valve supplying operating oil to that hydraulic actuator, and the like. Thus, the necessary discharge flow rate-operation amount ratio is often different for each hydraulic actuator. For example, as to the arm cylinder 37 and the bucket cylinder 38, the necessary discharge flow rate-operation amount ratio (denoted as H1) for the arm cylinder 37 is larger than the necessary discharge flow rate-operation amount ratio (denoted as H2) for the bucket cylinder 38. The correspondence relations shown in FIGS. 9 and 10 are set based on the respective necessary discharge flow rate-operation amount ratios. Note that when the working speed gain is adjusted and changed, the necessary discharge flow rate-operation amount ratio also changes according to change in the working speed gain.

If the arm cylinder 37 and the bucket cylinder 38 are made to operate at the same time, the controller 150 obtains the necessary rotational frequency of the first electric motor M1 corresponding to the signal level of the first operation output signal from the work operation lever 161 and the necessary rotational frequency of the first electric motor M1 corresponding to the signal level of the second operation output signal from the work operation lever 162 and adds them. Then the controller 150 outputs a rotational frequency control signal to control the rotational frequency of the first electric motor M1 to be the added necessary rotational frequency (called a sum necessary rotational frequency) to the inverter 106 so as to control the rotational frequency. For example, when the signal level of the first operation output signal is $K_{A1}$, and the signal level of the second operation output signal is $K_{B1}$, the necessary rotational frequency $R_{A1}$ for when the signal level is $K_{A1}$ and the necessary rotational frequency $R_{B1}$ for when the signal level is $K_{B1}$ are added to obtain the sum necessary rotational frequency (see FIGS. 9 and 10). Note that the sum necessary rotational frequency corresponds to the value obtained by multiplying the signal level $K_{A1}$ of the first operation output signal and the signal level $K_{B1}$ of the second operation output signal respectively by ratios H1 and H2 as weight coefficients and adding the values after the multiplication. By the first electric motor M1 rotating at the sum necessary rotational frequency, a flow of the necessary discharge flow rate for making the arm cylinder 37 and the bucket cylinder 38 operate at the same time is discharged from the first hydraulic pump P1. In this case, operating oil discharged from the first hydraulic pump P1 divides into for the arm cylinder 37 and for the bucket cylinder 38 to be supplied. At this time, the division ratio corresponds to the ratio of the necessary supply flow rate of the flow supplied from the control valve 114 to the arm cylinder 37 according to the operation amount of the work operation lever 161 to the necessary supply flow rate of the flow supplied from the control valve 115 to the bucket cylinder 38 according to the operation amount of the work operation lever 162. As to the control valves 114, 115, their respective opening characteristics are set beforehand such that, by their opening degrees being controlled according to the operation amounts of the work operation levers 161, 162, the division ratio corresponding to the ratio of the necessary supply flow rate for the arm cylinder 37 to the necessary supply flow rate for the bucket cylinder 38 is obtained. The necessary discharge flow rate of the flow discharged from the first hydraulic pump P1 is set to be larger than the sum of the necessary supply flow rate of the flow supplied from the control valve 114 to the arm cylinder 37 and the necessary supply flow rate of the flow supplied from the control valve 115 to the bucket cylinder 38.

Note that, if the arm cylinder 37 and the bucket cylinder 38 are made to operate at the same time, the controller 150 may add the signal level of the first operation output signal from the work operation lever 161 and the signal level of the second operation output signal from the right work operation lever 162 operated for making the bucket cylinder 38 operate. Then according to the added signal level (call a sum signal level), the controller 150 may control the rotational frequency of the first electric motor M1 such that as the sum signal level (the operation amount of the work operation lever 161 and the operation amount of the work operation lever 162) becomes larger, the flow rate of discharge from the first hydraulic pump P1 increases and that a flow of the necessary flow rate (necessary discharge flow rate) corresponding to the sum signal level is discharged from the first hydraulic pump P1.

Where the sum signal level is obtained, instead of simply adding the signal level of the first operation output signal and the signal level of the second operation output signal, the signal level of each operation output signal is preferably weighted according to the ratio between the necessary discharge flow rates (corresponding to the ratio of H1 to H2 between the necessary discharge flow rate-operation amount ratios) for the same signal level (operation amount) to be added. For example, if the arm cylinder 37 needs a larger discharge flow rate during operation than the bucket cylinder 38 even with the same signal level (operation amount), according to the ratio (e.g., 1.5:1.0) between the necessary discharge flow rates (e.g., the necessary discharge flow rates when the signal level (operation amount) is maximal), the signal level of the first operation output signal is multiplied by 1.5, and the signal level of the second operation output signal is multiplied by 1.0, and the signal levels after the multiplication are added to obtain a sum signal level. Then the necessary discharge flow rate (necessary rotational frequency) corresponding to the obtained sum signal level is obtained. Specifically, the obtained sum signal level is the signal level obtained by converting the signal level of the first operation output signal into a signal level of the second operation output signal and adding them, and hence by multiplying the sum signal level by the necessary discharge flow rate-operation amount ratio H2 corresponding to the bucket cylinder 38, the necessary discharge flow rate (necessary rotational frequency) can be obtained.

Although description has been made taking as an example the case where the arm cylinder 37 and the bucket cylinder 38 are made to operate at the same time, also when a plurality of (may be three or more) other working hydraulic actuators are made to operate at the same time, the same control is performed. As such, the configuration is made such that the rotational frequency of the first electric motor M1 is controlled according to the operation amount of the operation lever or the like and that thereby the flow rate of discharge from the first hydraulic pump P1 is controlled, so that a necessary amount of oil can be precisely supplied. Further, in the situation where a small flow rate of discharge from the first hydraulic pump P1 suffices, the rotational frequency of the first electric motor M1 can be made smaller, so that power consumption can be suppressed. Yet further, since the fixed-capacity-type first hydraulic pump P1 is used, cost can be suppressed and ease of maintenance is improved as compared with the use of a variable-capacity-type hydraulic pump. As opposed to the case of performing feedback control in which the flow rate of discharge from the hydraulic pump P1 is determined based on the difference between operating oil pressure on the first hydraulic pump P1 side and operating oil pressure on the working hydraulic actuator side, in control of the discharge flow rate, hunting is not likely to occur, nor is the responsivity likely to poor.

Figure 11:
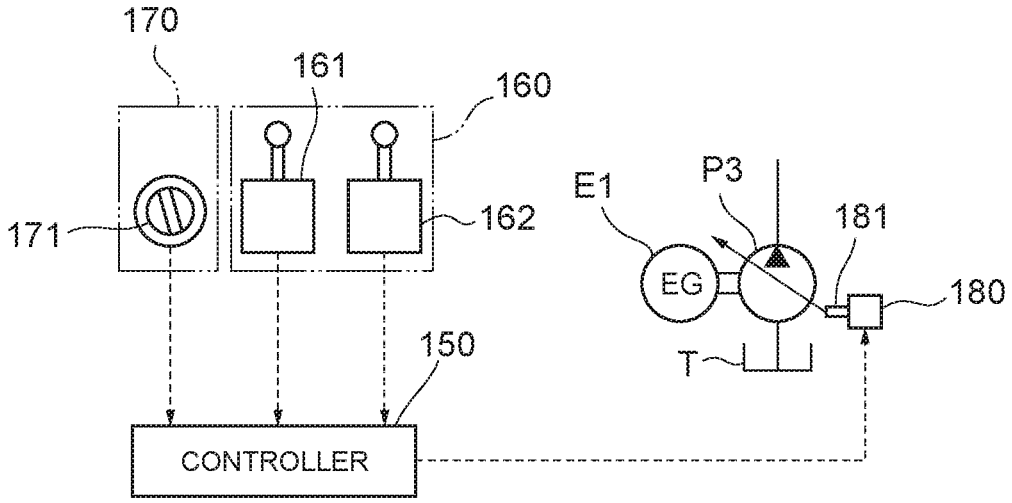
FIG. 11 is a diagram illustrating a configuration where a variable-capacity-type pump and an engine are used.

Although in the above description the first hydraulic pump P1 is a fixed-capacity-type hydraulic pump, a variable-capacity-type hydraulic pump may be used. In the case of using a variable-capacity-type hydraulic pump, the discharge flow rate control may be performed by controlling the capacity of the hydraulic pump. Further, in that case, the variable-capacity-type hydraulic pump may be driven by not an electric motor but an engine. FIG. 11 illustrates a variable-capacity-type hydraulic pump P3 driven by an engine E1. The capacity of the variable-capacity-type hydraulic pump P3 is controlled by a capacity control device 180 having, e.g., a piston 181 driven hydraulically or electromagnetically. With this configuration, the controller 150 has the capacity control device 180 operate to control the capacity of the variable-capacity-type hydraulic pump P3 according to a sum signal level obtained by adding the signal levels of the operation output signals from the operating device 160 such that as the sum signal level becomes larger, the flow rate of discharge from the variable-capacity-type hydraulic pump P3 increases. Further, a variable-capacity-type hydraulic pump may be used instead of the turning hydraulic pump P2, and the discharge flow rate control thereof may be performed by controlling the capacity of the hydraulic pump. In that case, the variable-capacity-type hydraulic pump may be driven by not an electric motor but an engine.

Although the embodiment of the present invention has been described above, the scope of the present invention is not limited to the above embodiment. For example, although the above embodiment describes the configuration where the opening degrees of the control valves 111 to 118 are controlled by pilot pressures supplied from the pilot pressure supply valve unit 130, a configuration may be made where, with electromagnetic proportional control valves as the control valves 111 to 118, the opening degrees of the control valves 111 to 118 are controlled electromagnetically. Or the opening degrees of the control valves 111 to 118 may be controlled using a drive device such as an electric motor. Although the above embodiment describes the configuration where pilot pressures are generated using operating oil from the first hydraulic pump P1, a configuration may be made where a for-pilot hydraulic pump, driven together with the first hydraulic pump P1 by the first electric motor M1, is provided and where pilot pressures are generated using operating oil from this for-pilot hydraulic pump.

A configuration may be made where the setting (initial setting) of an operating characteristic of the hydraulic actuator for the operation of an operation lever can be changed for each hydraulic actuator. For example, in order to change the setting of the correspondence relation between the operation amount of an operation lever and the working speed (the amount of supplied oil) of the corresponding hydraulic actuator, a configuration may be made where the setting of the necessary discharge flow rate-operation amount ratio can be changed or where the setting of the working speed gain value can be changed. A configuration can be made where this setting change is performed via, e.g., a portable computer (having a program to change the setting incorporated therein) or the like electrically connected to the controller 150.

Further, a configuration may be made where, when the crawler mechanisms 15 or the shovel device 30 are made to operate at the same time as the turning operation of the turning body 20, control is performed to decrease the discharge flow rate of the first hydraulic pump P1 by the magnitude of the discharge flow rate of the turning hydraulic pump P2 (to decrease the horsepower of the first hydraulic pump P1 by the magnitude of the horsepower of the turning hydraulic pump P2). Although the above embodiment illustrates an example where the present invention is applied to the hydraulic shovel, the present invention can be applied to working vehicles other than hydraulic shovels likewise to obtain the same effect.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

RELATED APPLICATIONS

This invention claims the benefit of Japanese Patent Application No. 2019-072591 which is hereby incorporated by reference.

What is claimed is:

1. An operation control device for a working vehicle which includes a plurality of hydraulic working devices, comprising:

a plurality of hydraulic actuators configured to drive the plurality of hydraulic working devices;

an operating oil supply source configured to send out operating oil necessary for driving the plurality of hydraulic actuators;

a sent-out oil amount control device configured to control an amount of oil sent out from the operating oil supply source;

an operating device configured to be operated with a plurality of kinds of operations to make the plurality of hydraulic actuators work in accordance with corresponding kinds of operations so as to drive the corresponding hydraulic working devices; and an operating oil supply control device configured to control to supply operating oil sent out from the operating oil supply source to the corresponding hydraulic actuator according to the kind of operation of the operating device and a working gain setting device, which is configured to set a working gain of the hydraulic actuators in response to operations of the operating device, wherein the operating oil supply control device is configured to control supply of operating oil to the corresponding hydraulic actuators based on a working gain set by the working gain setting device and in accordance with an operation of the operating device, the sent-out oil amount control device is configured to control the amount of oil sent out from the operating oil supply source according to the operation amount of the operating device and to the working gain, wherein when a plurality of operations are performed by the operating device, the sent-out oil amount control device is configured to control the amount of oil sent out from the operating oil supply source according to the sum operation amount of the plurality of operations with the working gain, wherein the operating oil supply source comprises a hydraulic pump and an electric motor configured to drive the hydraulic pump, and wherein the sent-out oil amount control device is configured to control the amount of oil sent out from the hydraulic pump by controlling the rotational speed of the electric motor according to the sum operation amount of the plurality of operations.

2. The operation control device for the working vehicle according to claim 1, wherein the operating device is configured to output an operation signal according to an operation amount, wherein when a plurality of operations are performed on the operating device, the sent-out oil amount control device is configured to control the amount of oil sent out from the operating oil supply source based on the sum of a plurality of operation signals outputted due to the plurality of operations.

3. The operation control device for the working vehicle according to claim 2, wherein when a plurality of operations are performed on the operating device, the sent-out oil amount control device is configured to weight the plurality of operation signals according to operating characteristics of the hydraulic actuators corresponding to the operations respectively and configured to control the amount of oil sent out from the operating oil supply source based on the sum of the plurality of weighted operation signals.

4. The operation control device for the working vehicle according to claim 3, wherein the operating characteristic of the hydraulic actuator is a necessary operating oil amount of the hydraulic actuator corresponding to an operation of the operating device.

5. The operation control device for the working vehicle according to claim 1, wherein the hydraulic pump is a fixed-capacity-type hydraulic pump.

* * * * *